US008960054B2

(12) United States Patent
Lin

(10) Patent No.: US 8,960,054 B2
(45) Date of Patent: Feb. 24, 2015

(54) SELECTIVE ONE-WAY WRENCH

(71) Applicant: Da-Sen Lin, Taichung (TW)

(72) Inventor: Da-Sen Lin, Taichung (TW)

(73) Assignee: Pard Hardware Industrial Co., Ltd., Taichung (TW)

( * ) Notice: Subject to any disclaimer, the term of this patent is extended or adjusted under 35 U.S.C. 154(b) by 211 days.

(21) Appl. No.: 13/763,444

(22) Filed: Feb. 8, 2013

(65) Prior Publication Data

US 2014/0224080 A1 Aug. 14, 2014

(51) Int. Cl.
*B25B 13/46* (2006.01)

(52) U.S. Cl.
CPC ..... *B25B 13/463* (2013.01)
USPC ..... 81/63.2; 81/63

(58) Field of Classification Search
USPC ..... 81/60–63.2
See application file for complete search history.

(56) References Cited

U.S. PATENT DOCUMENTS

| | | | | |
|---|---|---|---|---|
| 3,269,496 | A * | 8/1966 | Kilness | 192/43.2 |
| 5,230,262 | A * | 7/1993 | Ahlund et al. | 81/63.2 |
| 5,533,427 | A * | 7/1996 | Chow | 81/63.2 |
| 8,276,485 | B1 * | 10/2012 | Chen | 81/177.8 |
| 2003/0221522 | A1 * | 12/2003 | Wu | 81/63.2 |
| 2004/0244544 | A1 * | 12/2004 | Hsien | 81/63.2 |
| 2007/0000357 | A1 * | 1/2007 | Hsieh | 81/63.2 |

* cited by examiner

*Primary Examiner* — David B Thomas

(57) ABSTRACT

A selective one-way wrench includes a head, a rotor, a switch, a pawl and a torque spring. The head includes a first cavity defined therein, a second cavity in communication with the first cavity, and a third cavity in communication with the second cavity. The rotor is rotationally placed in the first cavity and formed with a gear. The switch includes a body pivotally inserted in the third cavity, a recess defined in the body, and a bore in communication with the recess. The pawl is movably placed in the second cavity and formed with a plurality of teeth engaged with the gear and a groove defined therein. The torque spring includes a helical portion placed in the recess, a first rectilinear end extending into the groove from the helical portion, and a second rectilinear end extending into the bore from the helical portion.

10 Claims, 6 Drawing Sheets

SELECTIVE ONE-WAY WRENCH

BACKGROUND OF INVENTION

1. Field of Invention

The present invention relates to a selective one-way wrench and, more particularly, to a selective one-way wrench that is easily switchable between two modes for transmitting high torque.

2. Related Prior Art

As disclosed in U.S. Pat. No. 1,957,462, a conventional ratchet wrench includes a body member 20, a toothed wheel 24, a pawl 25, a plunger 41, a spring 42 and a manipulator 46. The body member 20 includes a handle 21 extending from a head 22. The head 22 includes two recesses 23 and 26 in communication with each other. The toothed wheel 24 is rotationally placed in the recess 23. The toothed wheel 24 is formed with a non-cylindrical portion 34 for insertion in a socket so that the socket is rotatable together with the toothed wheel 24. The pawl 25 is movably placed in the recess 26 and formed with two pairs of teeth 40 on a side and two recesses 44 separated from each other by a protuberance 45 on an opposite side. The pairs of teeth 40 are for engagement with the toothed wheel 24. A selected one of the recesses 44 receives an end of the plunger 41, which includes an opposite end biased by the spring 42. The manipulator 46 is formed with a cylindrical portion 47 inserted in the pawl 25. There is a key 55 formed with an end inserted in the pawl 25 and an opposite end inserted in the cylindrical portion 47 of the manipulator 46 so that the pawl 25 is rotatable together with the manipulator 46. By manipulating the manipulator 46, the ratchet wrench is turned between two modes. In the first mode, the plunger 41 is inserted in the first recess 44. The first pair of teeth 40 is engaged with the toothed wheel 24. The handle 21 can be pivoted in a first direction to rotate the toothed wheel 24 via the head 22 and the pawl 25. The toothed wheel 24 cannot be rotated as the handle 21 is pivoted in a second direction opposite to the first direction because the first pair of teeth 40 is disengaged from the toothed wheel 24. In the second mode, the plunger 41 is inserted in the second recess 44. The second pair of teeth 40 is engaged with the toothed wheel 24. The handle 21 can be pivoted in the second direction to rotate the toothed wheel 24 via the head 22 and the pawl 25. The toothed wheel 24 cannot be rotated as the handle 21 is pivoted in the first direction because the second pair of teeth 40 is disengaged from the toothed wheel 24. This conventional ratchet wrench however suffers a serious drawback. It fails to transmit large torque in the first or second mode since the spring 42 is inadequate to keep the plunger 41 in the first or second recess 44 to keep the first or second pair of teeth 40 engaged with the toothed wheel 24. That is, it fails to tighten a nut on a screw or release a tightened nut from a screw.

As disclosed in Taiwanese Patent Publication No. 289994, another conventional ratchet wrench includes a body member 10, a toothed wheel 20, a pawl 30, a switch 41 and a spring 44. The body member 10 includes a handle 12 extending from a head 11 that includes a substantially crescent cavity between and in communication with two substantially circular cavities. The toothed wheel 20 is rotationally placed in the first circular cavity. The pawl 30 is a crescent element formed with a slot 32 and movably placed in the crescent cavity. The switch 41 includes a root 42 formed on a lower face, a recess 43 defined in the root 42, and a groove 45 defined in the lower face. The root 42 is placed rotationally in the second circular cavity. The spring 44 includes a helical portion, a first rectilinear portion 441 extending from the helical portion parallel to the axis of the helical portion, and a second rectilinear portion 442 transversely extending from the first rectilinear portion 441. The helical portion of the spring 44 is placed in the recess 43. The first rectilinear portion 441 of the spring 44 is placed in the groove 45 to avoid rotation of the spring 44. The second rectilinear portion 442 of the spring 44 is inserted in the slot 32. The switch 41 is maneuvered to switch the ratchet wrench between two modes. In the first mode, the pawl 30 is moved to a first end of the crescent cavity by the switch 41 via the spring 44. In the second mode, the pawl 30 is moved to a second end of the crescent cavity by the switch 41 via the spring 44. There is however lag in the movement of the pawl 30 by the switch 41 via the spring 44 as the second rectilinear portion 442 of the spring 44 is movable along the slot 32 because the length of the slot 32 is much larger than the diameter of the second rectilinear portion 442 of the spring 44.

The present invention is therefore intended to obviate or at least alleviate the problems encountered in prior art.

SUMMARY OF INVENTION

It is the primary objective of the present invention to provide a selective one-way wrench that is easily switchable between two modes for transmitting high torque.

To achieve the foregoing objective, the selective one-way wrench includes a head, a rotor, a switch, a pawl and a torque spring. The head includes a first cavity defined therein, a second cavity in communication with the first cavity, and a third cavity in communication with the second cavity. The rotor is rotationally placed in the first cavity and formed with a gear. The switch includes a body pivotally inserted in the third cavity, a recess defined in the body, and a bore in communication with the recess. The pawl is movably placed in the second cavity and formed with a plurality of teeth engaged with the gear and a groove defined therein. The torque spring includes a helical portion placed in the recess, a first rectilinear end extending into the groove from the helical portion, and a second rectilinear end extending into the bore from the helical portion.

Other objectives, advantages and features of the present invention will be apparent from the following description referring to the attached drawings.

BRIEF DESCRIPTION OF DRAWINGS

The present invention will be described via detailed illustration of the preferred embodiment referring to the drawings wherein:

FIG. 2 is an exploded view of the selective one-way wrench shown in

FIG. 1;

DETAILED DESCRIPTION OF PREFERRED EMBODIMENT

Figure 1:
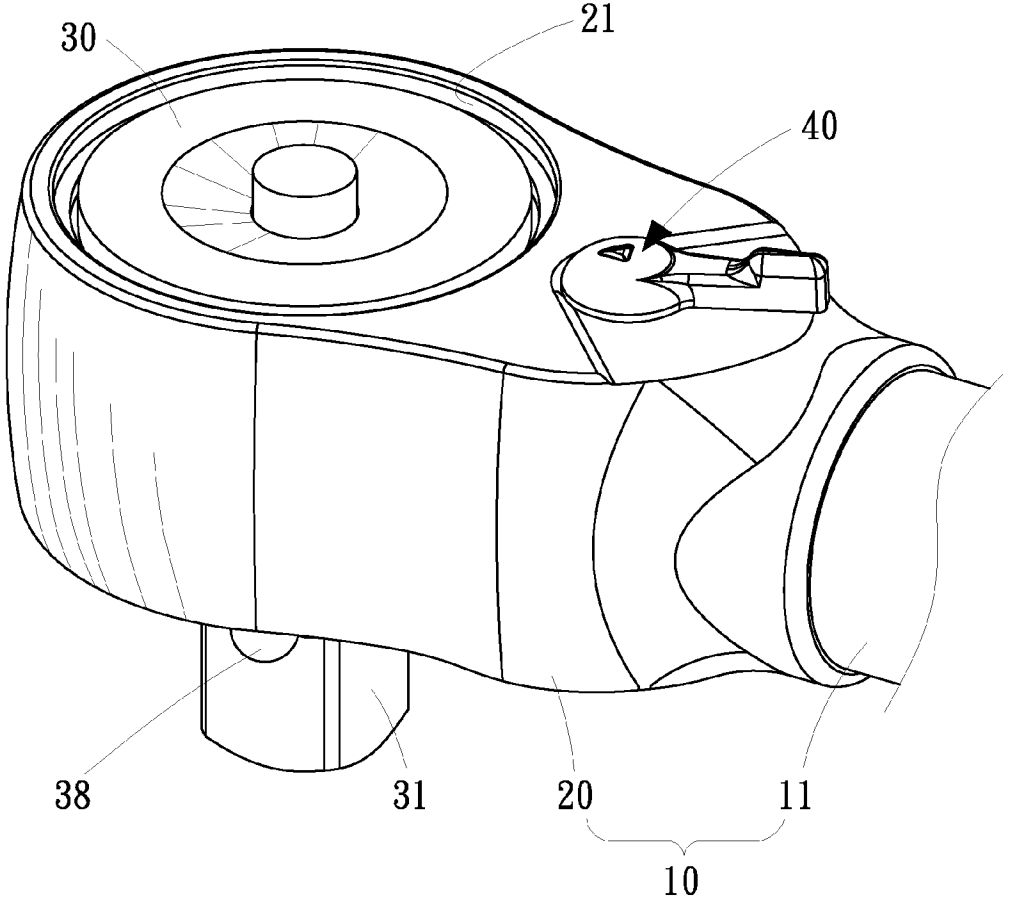
FIG. 1 is a partial perspective view of a selective one-way wrench according to the preferred embodiment of the present invention.

Referring to FIG. 1, a selective one-way wrench 10 according to the preferred embodiment of the present invention is shown. The wrench 10 includes a handle 11, a head 20, a rotor 30 and a mode-switching unit 40. The handle 11 extends from the head 20. The handle 11 includes an axial bore 23 for receiving an axle 12. A pinion 13 is formed at an end of the axle 12.

Figure 2:
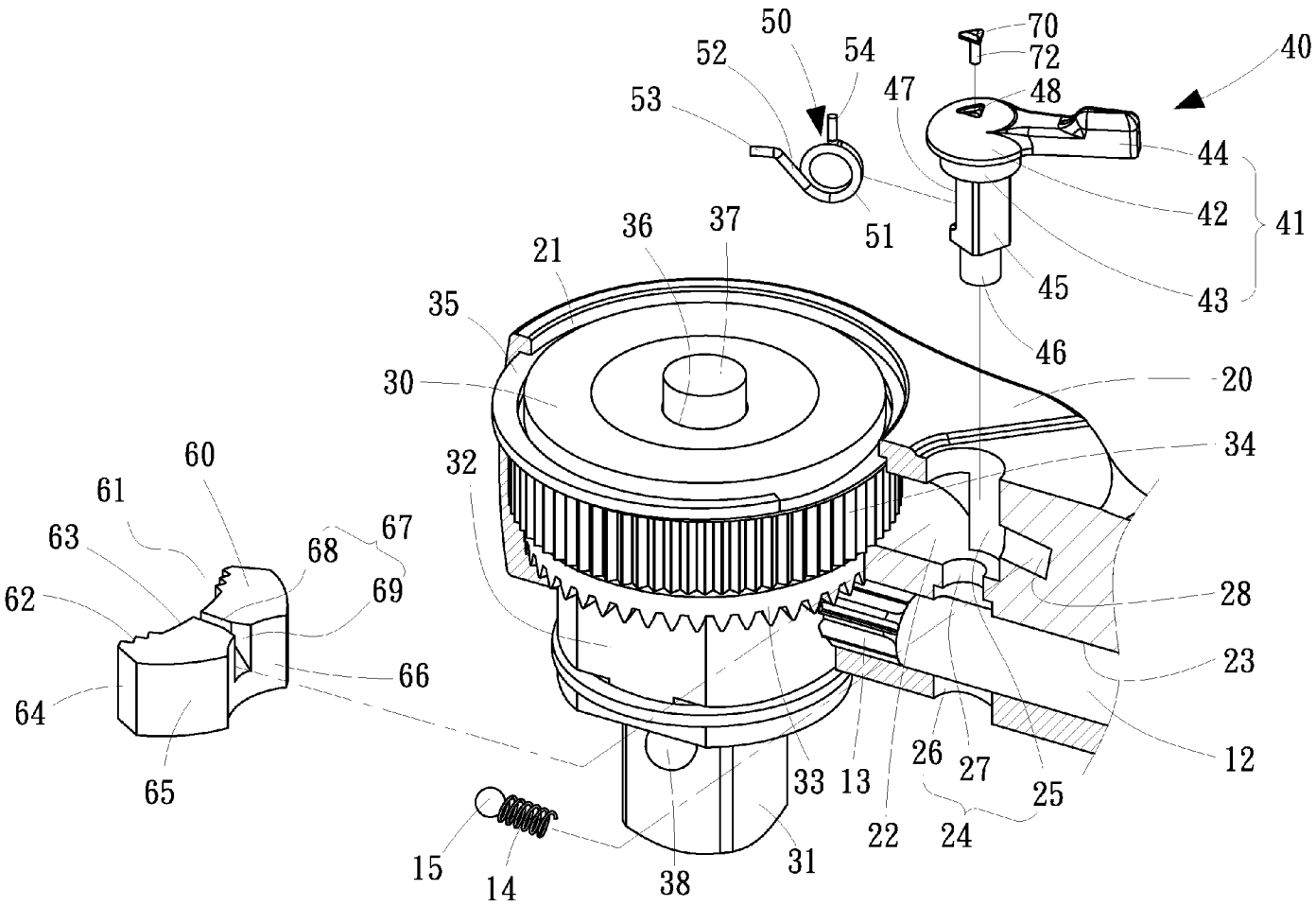

Referring to FIG. 2, the head 20 is a hollow element that includes three cavities 21, 22 and 24 and a bore 28. The cavities 21 and 24 are substantially circular cavities. The cavity 22 is a substantially crescent cavity between and in communication with the cavities 21 and 24. The cavity 24 includes an upper portion 25, a lower portion 26 and a middle portion 27. The bore 28 is a circular bore in communication with the upper portion 25 of the cavity 24. The axis of the bore 28 intersects the axes of the cavities 21, 22 and 24 that extend parallel to one another.

The rotor 30 includes an insert 31, a block 32, a crown gear 33 and a spur gear 34. The insert 31 is preferably made with a square cross-sectional shape. The block 32 is formed on the insert 31 and made with a non-circular cross-sectional shape. The crown gear 33 is formed on the block 32 and made with teeth on a lower face perpendicular to the axis. The spur gear 34 is formed on the crown gear 33 and made with teeth on the periphery around the axis.

A ball 38 is placed in a bore 36 defined axially in the rotor 30. The ball 38 includes a portion extensible from the bore 36 through an aperture in communication with the bore 36. A spring-loaded controlling unit 37 includes a lower portion in contact with the ball 38 in the bore 36 and an upper portion placed outside the bore 36. The upper portion of the controlling unit 37 can be pushed to allow the ball 38 to be inserted completely in the insert 31 to allow the insert 31 to be inserted in a socket. The upper portion of the controlling unit 37 can be released so that the controlling unit 37 keeps the portion of the ball 38 outside the insert 31 to retain the insert 31 in the socket.

Figure 3:
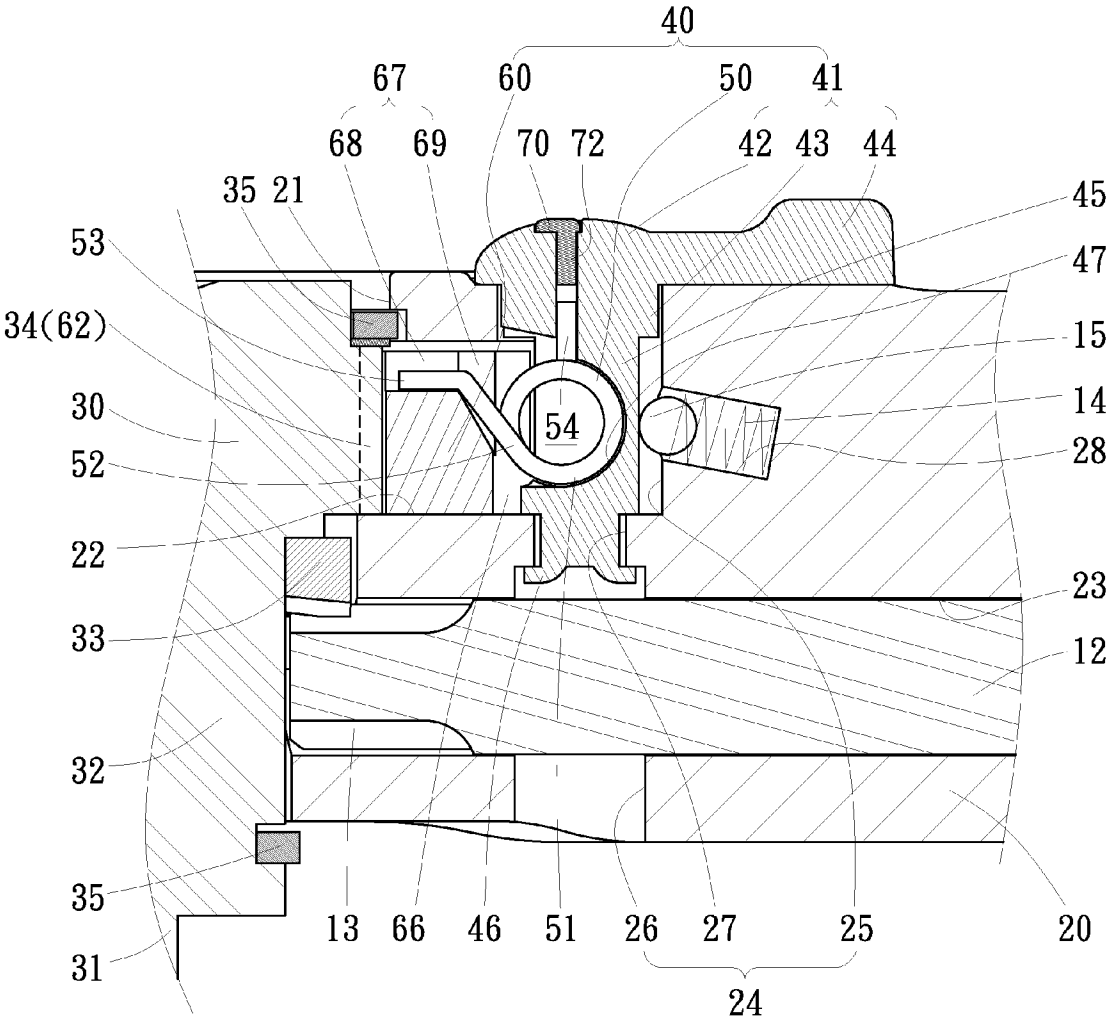
FIG. 3 is a cross-sectional view of the selective one-way wrench shown in FIG. 1.
Figure 4:
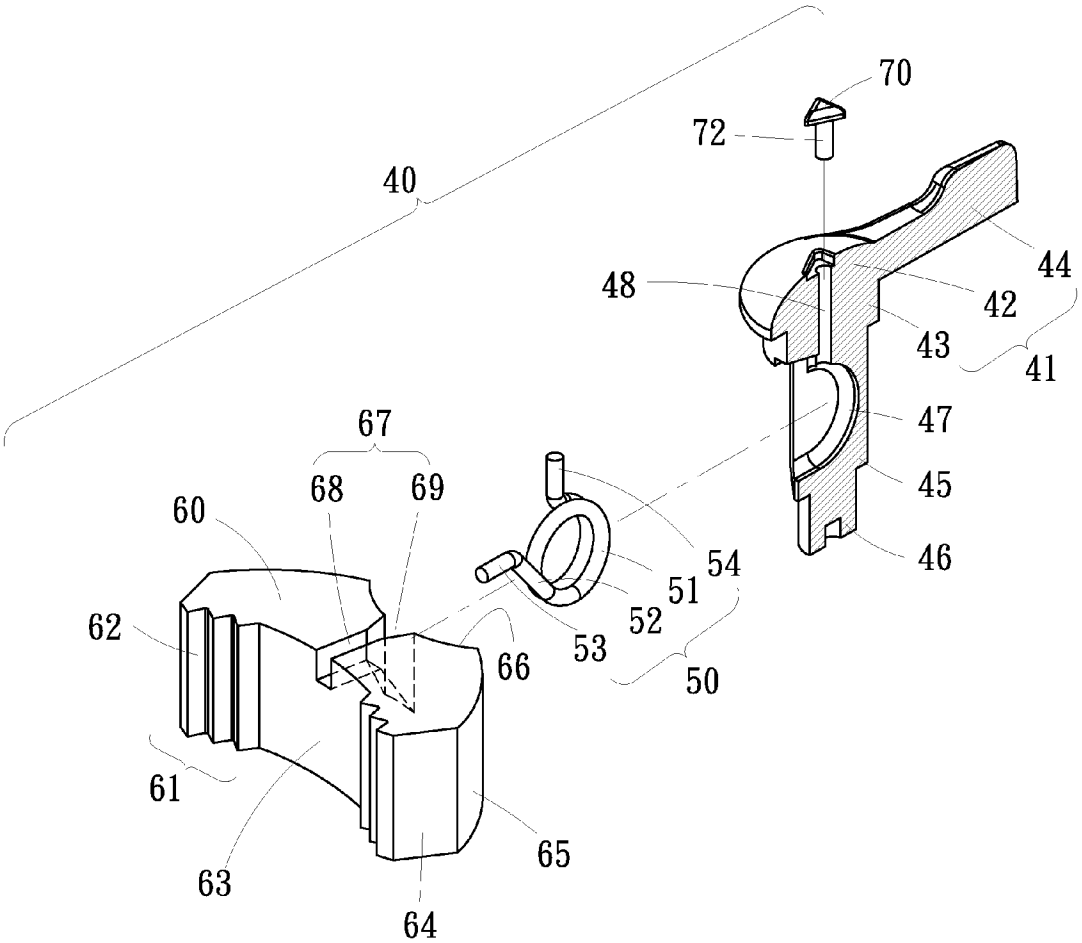
FIG. 4 is an exploded view of a mode-switching unit of the selective one-way wrench shown in FIG. 1.

Referring to FIGS. 3 and 4, the mode-switching unit 40 includes a switch 41, a torque spring 50, a pawl 60 and an indicator 70. The switch 41 includes a head 42, a neck 43, a lever 44, a body 45 and a foot 46. The head 42 is a circular disc with a bore 48 defined in an upper face. The bore 48 is triangular for example. The lever 44 extends from the head 42 in a radial direction. The neck 43 is a circular portion formed on a lower face of the head 42. The diameter of the neck 43 is smaller than that of the head 42. A bore 48 is defined in at least the neck 43. The body 45 is made with a square cross-sectional shape. A diagonal line of the body 45 is shorter than the diameter of neck 43. The body 45 includes a recess 47 that preferably extends into the body 45 along a diagonal line to which the lever 44 extends parallel. The recess 47 is in communication with the bore 48. The foot 46 is formed on a lower face of the body 45 and made with a circular cross-sectional shape. The diameter of the foot 46 is smaller than the sides of the body 45.

The torque spring 50 includes a helical portion 51, a rectilinear portion 52 and two rectilinear ends 53 and 54. The rectilinear portion 52 extends from the helical portion 51 in a tangential direction. The first rectilinear end 53 extends from the rectilinear portion 52 at an angle.

The pawl 60 includes two engagement units 61, a front face 63, two lateral faces 64, a rear face 65, a recess 66 and a groove 67. The front face 63 is a concave face. The rear face 65 is substantially a convex face except the recess 66 extending in a middle portion. The lateral faces 64 extend between the front face 63 and the rear face 65. The groove 67 is defined in an upper face of the pawl 60. The groove 67 includes an even portion 68 and a conical portion 69 that gets wider and deeper as it extends from the even portion 68. The engagement units 61 are formed on the front face 63. Each of the engagement units 61 is in the vicinity of a corresponding of the lateral faces 64 and includes preferably three teeth 62.

The indicator 70 includes a rod 72 extending from a head. The head of the indicator 70 is preferably a triangular plate.

A spring 14 and a ball 15 are placed in the bore 28. The spring 14 is compressed between the ball 15 and a closed end of the bore 28. The ball 15 is formed with a portion placed in the bore 28 and an opposite portion placed in the upper portion 25 of the cavity 24.

The foot 46 is inserted in the lower portion 26 of the cavity 24 via the middle portion 27 of the cavity 24. The body 45 and the neck 43 are placed in the upper portion 25 of the cavity 24. The body 45 is in contact with the ball 15. The head 42 and the lever 44 are placed outside the cavity 24.

The second rectilinear end 54 is fit in the bore 48. The helical portion 52 is fit in the recess 47. It is preferred that the torque spring 50 is kept in the body 45 except the rectilinear portion 52 and the first rectilinear end 53.

The pawl 60 is placed in the cavity 22. The first rectilinear end 53 of the torque spring 50 is fit in the even portion 68 of the groove 67 while the rectilinear portion 52 of the torque spring 50 is placed in the conical portion 69 of the groove 67.

The spur gear 34, the crown gear 33 and a substantial portion of the block 32 are placed in the cavity 21. The crown gear 33 is engaged with the pinion 13. The spur gear 34 is engaged with both of the engagement units 61.

An internal edge of a lower C-clip 35 is placed in an annular groove defined in the periphery of the block 32. An external edge of an upper C-clip 35 is placed in a groove defined in the wall of the cavity 21. Thus, the spur gear 34 and the crown gear 33 are kept in the cavity 21.

The rod 72 is inserted in the bore 48. The head of the indicator 70 is placed in a cavity in communication with the bore 48.

Figure 5:
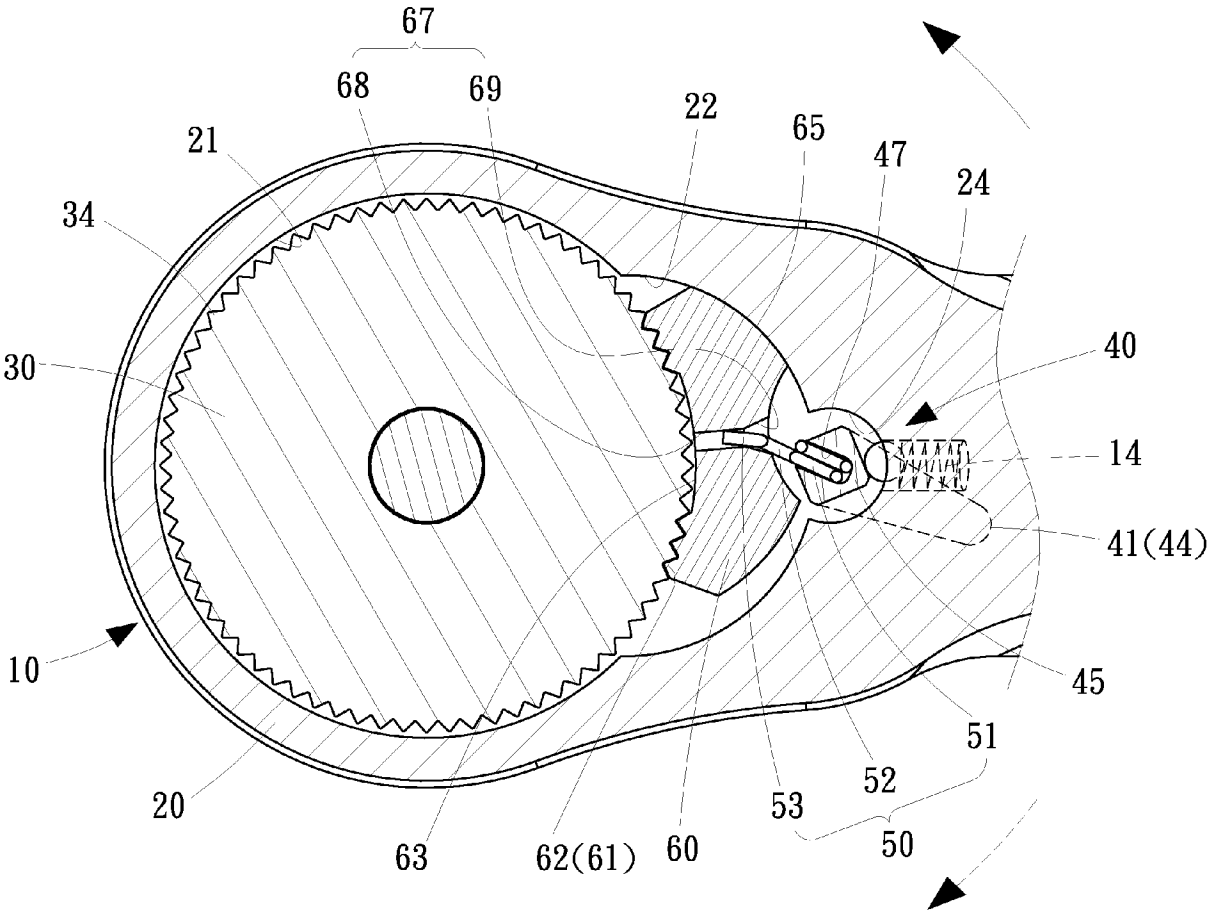
FIG. 5 is another cross-sectional view of the selective one-way wrench shown in FIG. 1.

Referring to FIG. 5, the lever 44 is operated to pivot the switch 41 clockwise. The pawl 60 is moved to a first position by the switch 41 via the torque spring 50. The pawl 60 is kept in the first position by the switch 41 via the torque spring 50 as a facet of the body 45 is in firm contact with the ball 15 biased by the spring 14. Both of the engagement units 61 are engaged with the spur gear 34.

Figure 6:
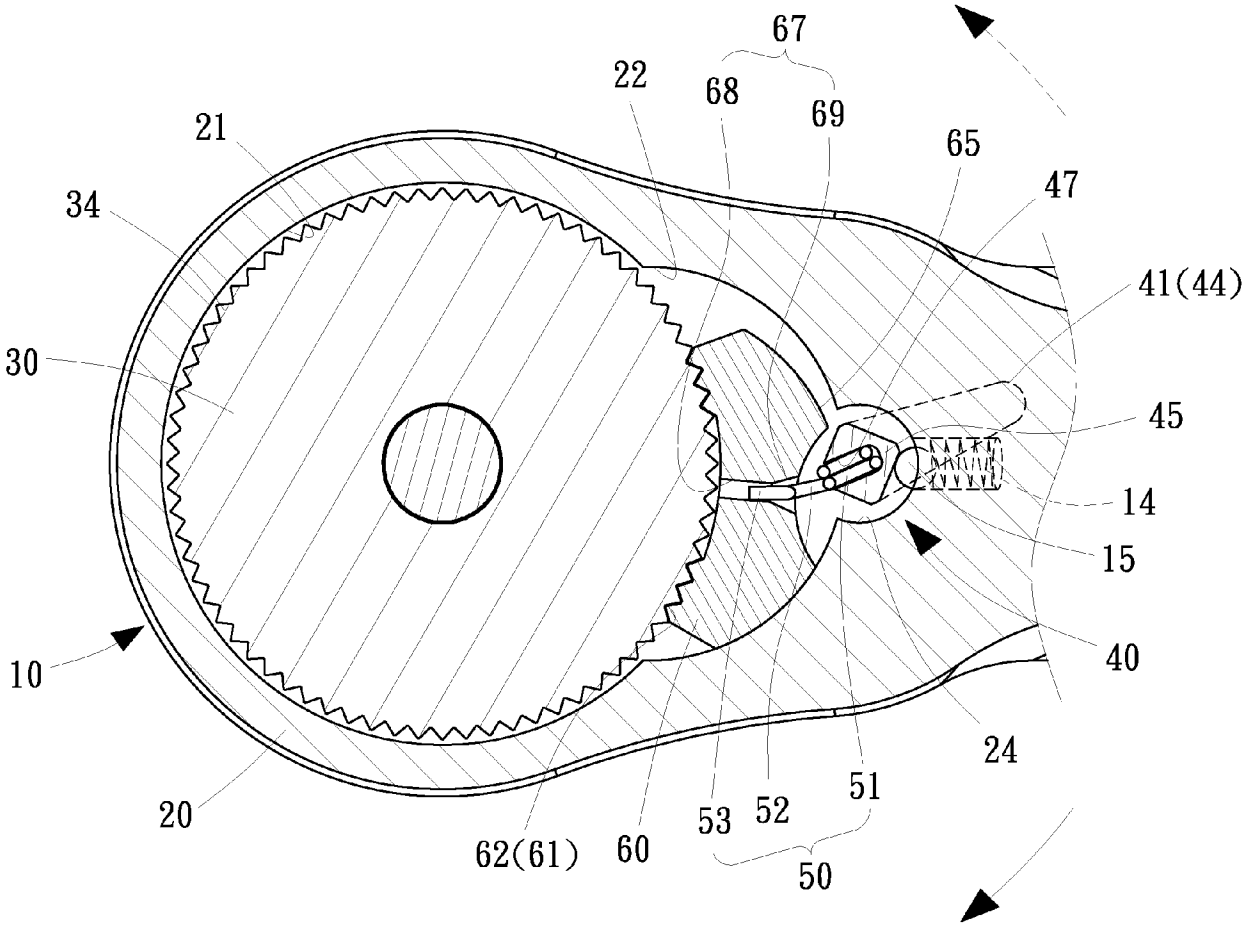
FIG. 6 is a cross-sectional view of the selective one-way wrench in another position than shown in FIG. 5.

Referring to FIG. 6, the lever 44 is operated to pivot the switch 41 counterclockwise. The pawl 60 is moved to a second position by the switch 41 via the torque spring 50. The pawl 60 is kept in the second position by the switch 41 via the torque spring 50 as another facet of the body 45 is in firm contact with the ball 15 biased by the spring 14. Both of the engagement units 61 are engaged with the spur gear 34.

The first rectilinear end 53 of the torque spring 50 is pivoted in the even portion 68 of the groove 67 to a limited extent since the diameter of the first rectilinear end 53 of the torque spring 50 is marginally smaller than the width of the even portion 68 of the groove 67. Advantageously, there is substantially no lag of the movement of the pawl 60 from the pivoting of the switch 41 because the helical portion 51 of the torque spring 50 is with fit in the recess 47 and the first rectilinear end 53 of the torque spring 50 is pivoted in the even portion 68 of the groove 67 to a limited extent.

Advantageously, the selective one-way wrench 10 can be used to exert large torque because both of the engagement units 61 are engaged with the spur gear 34 and the pawl 60 is squeezed by the wall of the cavity 22 and the spur gear 34 when the handle 11 is pivoted in an active direction, clockwise or counterclockwise, depending on which mode the selective one-way wrench 10 is in.

Advantageously, the first rectilinear end 53 and rectilinear portion 52 of the torque spring 50 will not be bent considerably and broken in the worst scenario because the first rectilinear end 53 of the torque spring 50 is pivoted in the even portion 68 of the groove 67 and the rectilinear portion 52 of the torque spring 50 can be pivoted in the conical portion 69 of the groove 67.

Advantageously, the recess 66 provides adequate space for the pivoting of the torque spring 50 and the switch 41.

The present invention has been described via the detailed illustration of the preferred embodiment. Those skilled in the art can derive variations from the preferred embodiment without departing from the scope of the present invention. Therefore, the preferred embodiment shall not limit the scope of the present invention defined in the claims.

The invention claimed is:

1. A mode-switching unit including:

a head;

a rotor placed in the head; and a mode-switching unit including:

a switch including a body, a recess defined in the body, and a bore in communication with the recess;

a pawl including a groove defined therein, wherein the pawl is adapted for engagement with the rotor; and a torque spring including a helical portion and first and second rectilinear ends and extending from the helical portion, wherein the first rectilinear end is inserted in the groove, wherein the second rectilinear end is inserted in the bore, wherein the helical portion is placed in the recess.

2. A selective one-way wrench including the mode-switching unit according to claim 1, wherein the head includes a first cavity for receiving the rotor, a second cavity for receiving the pawl, and a third cavity for receiving the body of the switch.

3. A selective one-way wrench including:

a head including a first cavity defined therein, a second cavity in communication with the first cavity, and a third cavity in communication with the second cavity;

a rotor rotationally placed in the first cavity and formed with a gear;

a switch including a body pivotally inserted in the third cavity, a recess defined in the body, and a bore in communication with the recess;

a pawl movably placed in the second cavity and formed with a plurality of teeth engaged with the gear and a groove defined therein; and a torque spring including a helical portion placed in the recess, a first rectilinear end extending into the groove from the helical portion, and a second rectilinear end extending into the bore from the helical portion.

4. The selective one-way wrench according to claim 3, wherein the switch includes a lever operable for pivoting the switch.

5. The selective one-way wrench according to claim 3, further including an indicator attached to the switch near the lever.

6. The selective one-way wrench according to claim 5, wherein the indicator includes a rod inserted in the bore.

7. The selective one-way wrench according to claim 3, wherein the groove includes:

an even portion for receiving a portion of the first rectilinear end of the torque spring; and a conical portion for allowing the pivoting of the first rectilinear end.

8. The selective one-way wrench according to claim 7, wherein the conical portion of the groove expends as it extends from the even portion of the groove.

9. The selective one-way wrench according to claim 8, wherein the pawl includes a rear face for contact with a wall of the first cavity.

10. The selective one-way wrench according to claim 9, wherein the pawl includes a recess defined in the rear face to provide adequate space for the pivoting of the torque spring and the switch.

* * * * *